US010045896B2

(12) United States Patent
Tsushima

(10) Patent No.: US 10,045,896 B2
(45) Date of Patent: Aug. 14, 2018

(54) STANDING-UP ASSIST TOOL AND WALKING SUPPORT DEVICE

(71) Applicant: TSUSHIMA IRONWORKS CO., LTD., Kyoto-shi, Kyoto (JP)

(72) Inventor: Yoshihiko Tsushima, Joyo (JP)

(73) Assignee: TSUSHIMA IRONWORKS CO., LTD., Kyoto-shi (JP)

( * ) Notice: Subject to any disclaimer, the term of this patent is extended or adjusted under 35 U.S.C. 154(b) by 111 days.

(21) Appl. No.: 14/929,649

(22) Filed: Nov. 2, 2015

(65) Prior Publication Data

US 2016/0158080 A1 Jun. 9, 2016

(30) Foreign Application Priority Data

Dec. 4, 2014 (JP) ..... 2014-246246
Oct. 6, 2015 (JP) ..... 2015-198787

(51) Int. Cl.
*A61G 5/14* (2006.01)
*A61G 5/12* (2006.01)
*A61H 3/04* (2006.01)

(52) U.S. Cl.
CPC ..... *A61G 5/14* (2013.01); *A61G 5/125* (2016.11); *A61H 3/04* (2013.01); *A61G 5/12* (2013.01); *A61H 2201/1238* (2013.01); *A61H 2201/1409* (2013.01)

(58) Field of Classification Search
CPC ..... A61H 3/04; A61H 2201/1409; A61G 5/14
See application file for complete search history.

(56) References Cited

U.S. PATENT DOCUMENTS 3,165,314 A * 1/1965 Clearman ..... A61H 3/04 135/67
3,596,298 A * 8/1971 Durst, Jr. ..... A61G 7/1017 297/411.1
4,985,947 A * 1/1991 Ethridge ..... A61G 7/1017 280/250.1

(Continued)

FOREIGN PATENT DOCUMENTS

CA 2741541 A1 * 11/2012 ..... A61G 7/1038
FR 2560766 A1 * 9/1985 ..... A61H 3/04

(Continued)

*Primary Examiner* — David R Dunn
*Assistant Examiner* — Danielle Jackson
(74) *Attorney, Agent, or Firm* — Westerman, Hattori, Daniels & Adrian, LLP

(57) ABSTRACT

The present invention is provided with a support mechanism for an armrest part that includes a gas spring. The support mechanism supports the armrest part in a state of being able to change a posture between an ordinary posture and a forward-tilt posture when the gas spring is locked, and the support mechanism supports the armrest part so as to make the armrest part move with forming an arc from a sitting corresponding position to a standing corresponding position that is located at a forward upper position when the gas spring is unlocked. A gas spring switch part that does not obstruct the locked state of the gas spring when the armrest part is in the ordinary posture and that releases the locked state of the gas spring at a time when the armrest part is in the forward-tilt posture is arranged between the gas spring and the armrest part.

5 Claims, 15 Drawing Sheets

(56) References Cited

U.S. PATENT DOCUMENTS

| | | | | |
|---|---|---|---|---|
| 6,308,981 | B1 * | 10/2001 | Proehl | A61G 7/1017 280/47.34 |
| 6,733,018 | B2 * | 5/2004 | Razon | A61H 3/008 135/67 |
| 8,151,812 | B2 * | 4/2012 | Razon | A61H 3/04 135/66 |
| 8,468,622 | B2 * | 6/2013 | Purwar | A61G 7/1017 297/5 |
| 9,180,066 | B2 * | 11/2015 | Izard | A61H 3/008 |
| 9,468,579 | B1 * | 10/2016 | Fulkerson | A61H 3/04 |
| 9,579,249 | B2 * | 2/2017 | Fulkerson | A61H 3/008 |
| 2013/0069407 | A1 * | 3/2013 | Park | A61G 5/14 297/313 |
| 2013/0221716 | A1 * | 8/2013 | Purwar | A61G 7/1017 297/311 |
| 2015/0190293 | A1 * | 7/2015 | Hacikadiroglu | A61G 7/1017 5/87.1 |
| 2016/0051427 | A1 * | 2/2016 | Purwar | A61G 7/1046 482/5 |
| 2017/0216127 | A1 * | 8/2017 | Fulkerson | A61H 3/04 280/47.41 |

FOREIGN PATENT DOCUMENTS

| | | | | |
|---|---|---|---|---|
| GB | 1337807 | A * | 11/1973 | A61G 5/14 |
| JP | 2005-118154 | A | 5/2005 | |
| JP | WO 2015145758 | A1 * | 10/2015 | A61G 7/1019 |
| WO | WO 8604813 | A1 * | 8/1986 | A61H 3/04 |

* cited by examiner

STANDING-UP ASSIST TOOL AND WALKING SUPPORT DEVICE

FIELD OF THE ART

This invention relates to a standing-up assist tool and a walking support device that are especially preferably utilized in medical facilities or welfare facilities.

BACKGROUND ART

Conventionally, a walker (for example, refer to the patent document 1) comprising an armrest is known for age persons or persons who require rehabilitation.

The walker comprises wheels that are arranged at a lower part of a walker body and a direction of whose axle is variable, and generally horizontal armrests each of which is fixed to the right or the left of an upper part of the walker body respectively, and the right armrest and the left armrest extend forward and a distance between the right armrest and the left armrest is gradually narrowed toward the forward and then the right armrest and the left armrest are connected at a connecting part at the front end side to be united.

In case of using this walker, a user puts his/her body into a concave part formed at a position to face the right and left armrests and the connecting part, puts his/her elbow on the right and left armrests, and puts his/her hand of the connecting part and with this state kept the user puts his/her weight on the walker and moves.

PRIOR ART DOCUMENTS

Patent Document

Patent document 1: Japanese Unexamined Patent Application Publication No. 2005-118154

DISCLOSURE OF THE INVENTION

Problems to be Solved by the Invention

However, in accordance with this walking support device, it is indispensable for a helper to assist a person who is unable to stand up by himself/herself from a sitting posture to a standing-up posture.

Especially, in case that the helper helps the user stand up and walk, since the helper has to receive the user's weight tentatively, after the user is in a standing-up posture to a certain degree, the helper helps the user put the user's weight on the armrest of the walking support device and shift the user's weight to the armrest, it requires a lot of labor.

In addition, in case that the helper changes underwear or a diaper of the user, there is a case that a height of the armrest of the walker is too high. In this case, if furniture whose height is suitable for the user to hang on is around the user, it is possible to let the user hang on the furniture and help the user stand up, otherwise two helpers are required for helping the user stand up, such that one helper helps the user stand up while other helper supports the user's weight.

A walking support device disclosed in, for example, the patent document, Japanese Unexamined Patent Application Publication No. 8-215250 has been known as the walking support device having the above-mentioned arrangement. This walking support device is so configured that an armrest is driven along a linear motion axis that bends forward, and a grip part and an operation part are provided for the armrest part and a belt for supporting the user's trunk, a rear part of the user's waist, is provided. When the user grips the grip part and operates a switch as being the operation part, the armrest part rises diagonally forward and the belt pushes out the user's waist according to the motion of the armrest so as to assist a standing-up motion of the user.

However, this walking support device is large-scaled and costly. In addition, even though the user is in the standing posture, it is difficult for this walking support device to assist the user to walk.

The present claimed invention intends to effectively solve all of the problems.

Means to Solve the Problems

In order to attain this object, the following measures are taken.

More specifically, a standing-up assist tool of this invention is to support an armrest part by means of a supporting mechanism comprising a gas spring, and is characterized by that the support mechanism supports the armrest part in a state of being able to change a posture between an ordinary posture and a forward-tilt posture in a state that the gas spring is locked, and supports the armrest part so as to make the armrest part move with forming an arc from a sitting corresponding position to a standing corresponding position that is located at a forward upper position in a state that the gas spring is unlocked, and a gas spring switch part that does not obstruct the locked state of the gas spring at a time when the armrest part is in the ordinary posture and that releases the locked state of the gas spring at a time when the armrest part is in the forward-tilt posture is provided between the gas spring and the armrest part.

In accordance with this arrangement, when the user in the sitting posture covers the armrest from the upper part and puts his/her weight on the armrest part, the armrest part tilts forward and a locked state of the gas spring is released. As a result of this, a lifting force to upward is applied to the armrest part so that a force required for the user to stand up is reduced. If the forward tilt posture of the armrest part is released at a time when the armrest part is located at the standing corresponding position or a middle position that is before the standing corresponding position, the gas spring is locked and the armrest part is supported at the position in the ordinary posture. In this state, the locked state of the gas spring is not released even though the downward load is applied on the armrest part and it is possible for the user to put his/her weight on the armrest part. In case of a sitting motion, a reverse operation to the above-mentioned motion can assist the user to take the sitting posture by reducing the weight of the user by means of the gas spring.

As a preferable embodiment represented is the support mechanism that comprises an arm that makes a rotational movement around a first fixed fulcrum and the gas spring that makes a rotational movement around a second fixed fulcrum, and a support part that is set at a user side is supported by a rotational movement end part of the arm and a support part that is set at an opposite user side of the armrest part is supported by a rotational movement end part of the gas spring, and is characterized by that the support part at the user side is mounted in a rotatable manner around a first movable fulcrum set on the rotational movement end part of the arm and the support part at the opposite user side is mounted in a rotatable manner around a second movable fulcrum set on the rotational movement end part of the gas spring, and the armrest part is so configured that it can take both the ordinary posture and the forward-tilt posture that tilts forward from the ordinary posture while accompanying the rotational movement of the arm around the first fixed fulcrum and the rotational movement of the gas spring around the second fixed fulcrum in a state that the gas spring is locked.

More preferably, it is preferable that the arm is provided with a rotational movement operation input part that allows a foot to step on at a position at the opposite side of the rotational movement end part of the arm across the first fixed fulcrum.

As the gas spring switch part, it is preferable that the gas spring switch part has a pressing part at a position where the pressing part directly or indirectly acts on an input end of the gas spring when the armrest part is in the forward-tilt posture, and the pressing part can be operated separately from a movement of the armrest part by a handle that is attached to the armrest part and that extends to the opposite user side.

In order to further simplify and stabilize the motion, it is preferable that a grip part is located in front of the armrest part.

The standing-up assist tool having the above-mentioned arrangement can be preferably used as a walking support device wherein the first fixed fulcrum and the second fixed fulcrum are set on a device body that is supported by casters and that has a concave part which a user can get into and the arm and the gas spring are mounted on the device body.

Effect of the Invention

In accordance with the above-mentioned invention, in case that the helper assists a person (user) who cannot stand up by himself/herself, it is not necessary for the helper to carry the user's weight and it can be avoided that the helper's both hands are occupied during a period while the user moves from a sitting posture to a standing posture so that it is possible for the helper to largely reduce a load for helping the user stand. Especially, since the armrest part plays a role as an ON/OFF switch of the gas spring, it is convenient. In addition, since the armrest part can be locked at any height, it is possible for the helper to use the standing-up assist tool at an appropriate height in case that the helper helps the user in a half-sitting posture. As a result of this, the load conducted by two or more helpers can be remarkably reduced. It is a matter of course that the standing-up assist tool having this function can be a useful help for the user when the user conducts the standing up motion or the sitting motion by himself/herself.

BEST MODES OF EMBODYING THE INVENTION

One embodiment of this invention will be explained with reference to drawings.

Figure 1:
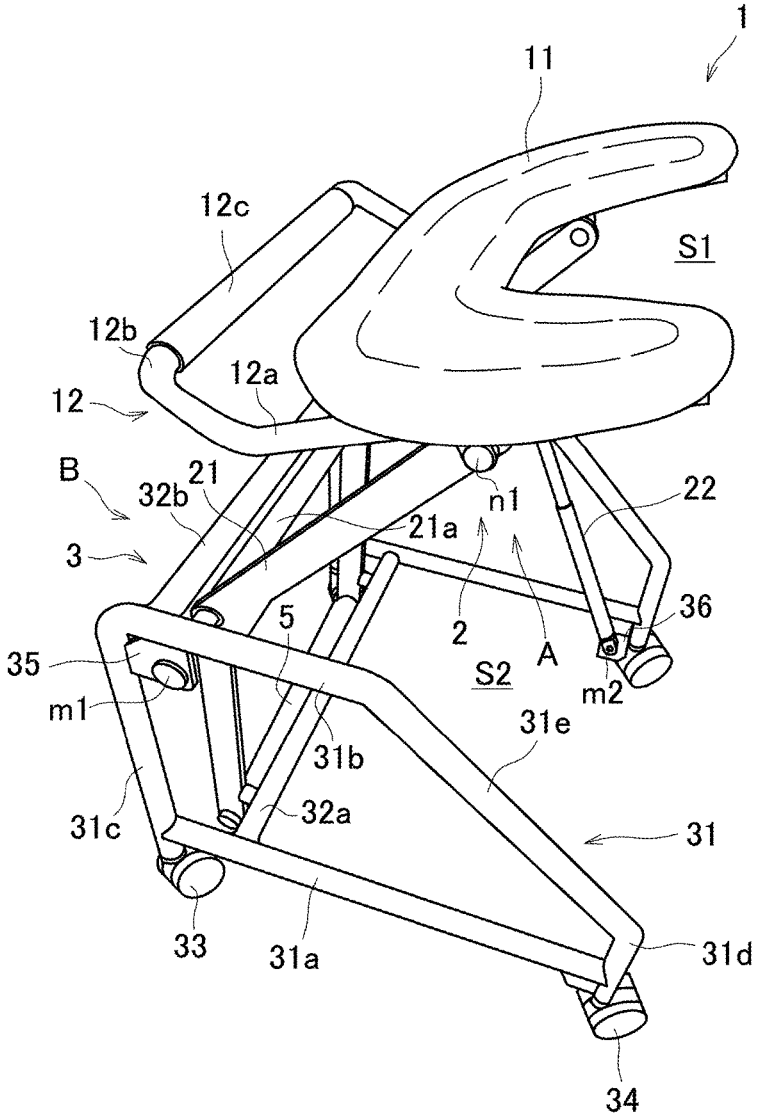
FIG. 1 is a perspective view of a walking support device in accordance with one embodiment of this invention.
Figure 2:
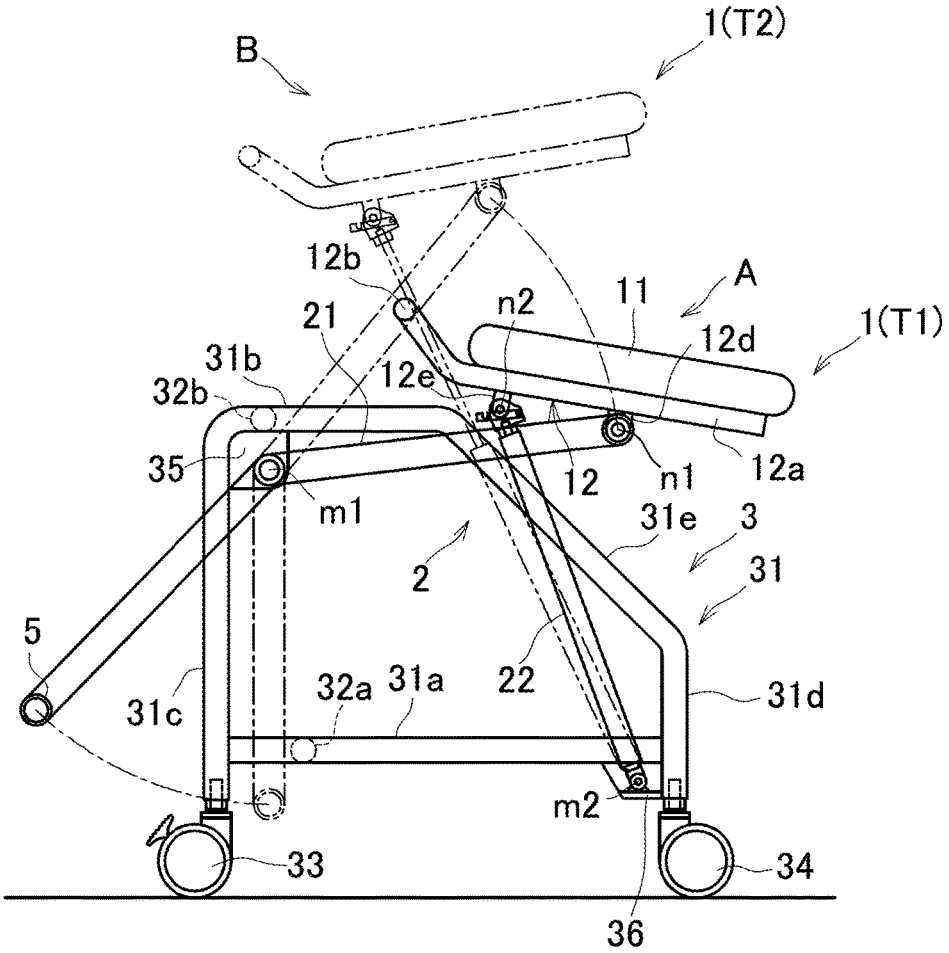
FIG. 2 is a side view wherein a part of the view in FIG. 1 is omitted.
Figure 3:
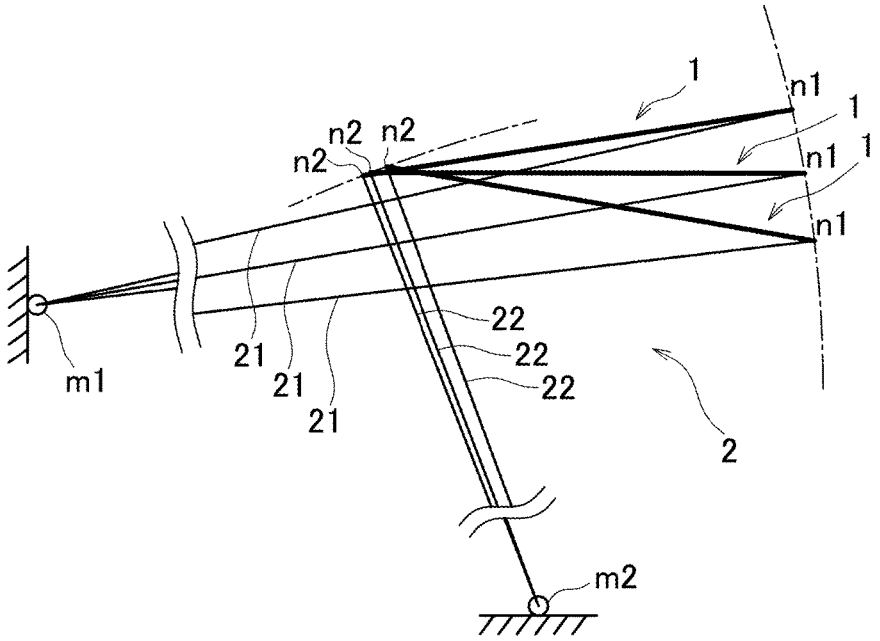
FIG. 3 is a mechanism explanatory view of a support mechanism constituting a standing-up assist tool of this embodiment.
Figure 4:
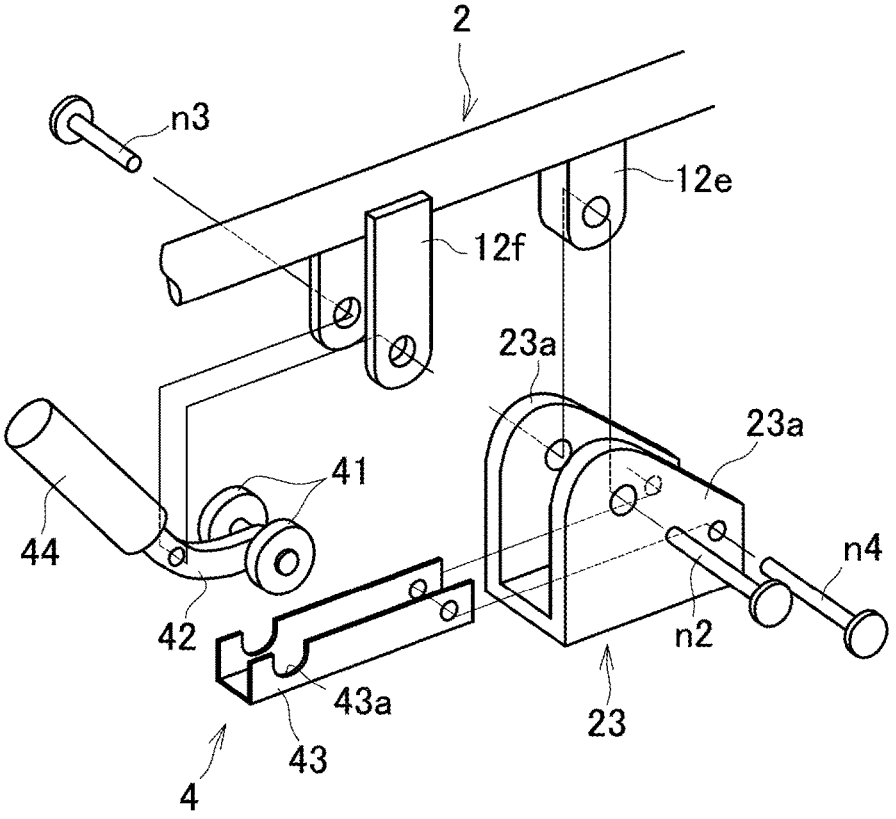
FIG. 4 is an exploded perspective view of a principal part in accordance with a gas spring switch part of this embodiment.
Figure 5:
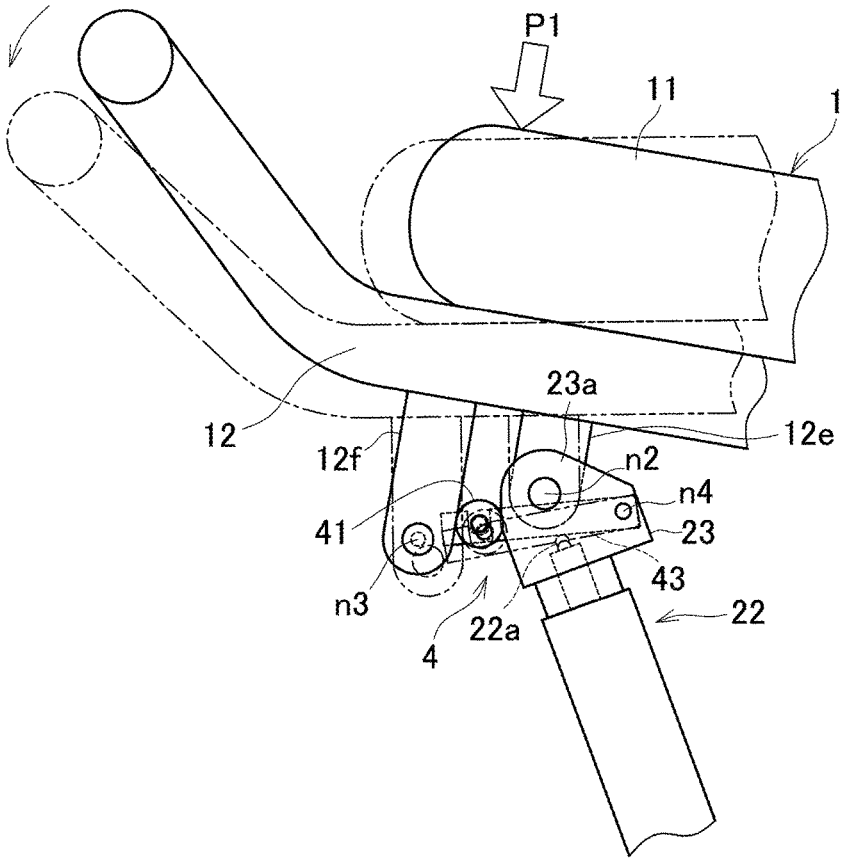
FIG. 5 is an enlarged partial side view of the principal part showing a function in accordance with the gas spring switch part of this embodiment.
Figure 6:
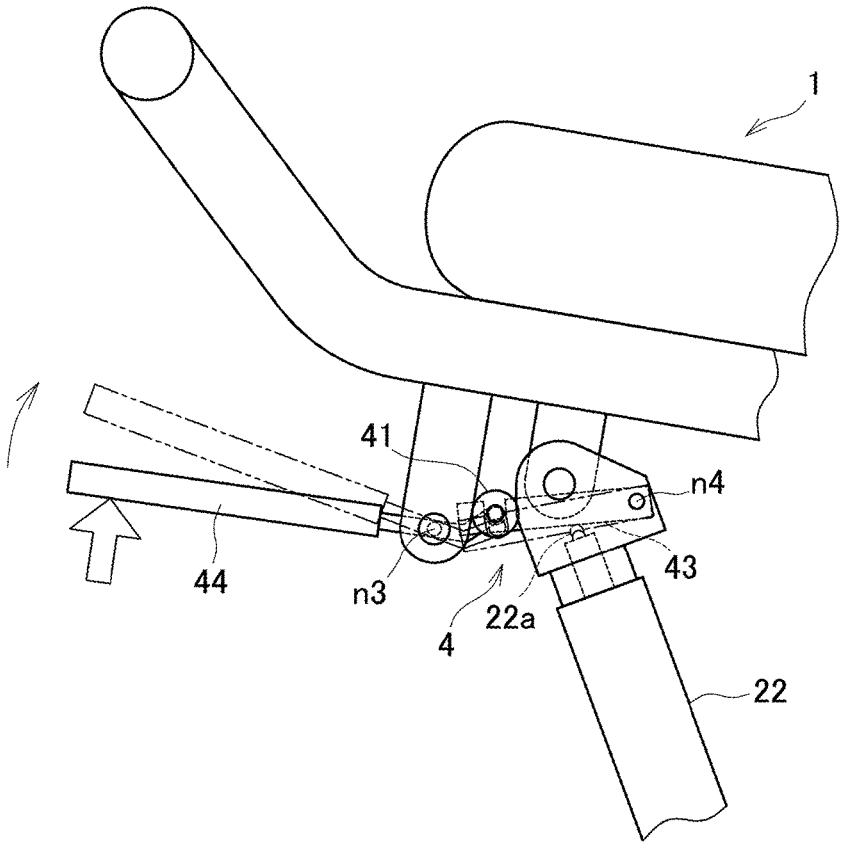
FIG. 6 is an enlarged partial side view of the principal part showing the function in accordance with the gas spring switch part of this embodiment.

FIG. 1 shows a walking support device (B) into which a standing-up assist tool (A) of this embodiment is incorporated, FIG. 2 is a side view wherein a part shown in FIG. 1 is omitted, FIG. 3 is a mechanism explanatory view of a support mechanism 2 constituting the standing-up assist tool (A), FIG. 4 is an exploded perspective view of a principal part of a gas spring switch part 4, FIG. 5 and FIG. 6 are enlarged partial side views of a principal part showing a function of the gas spring switch part 4, and FIG. 7~FIG. 10 are a view showing a use state.

As shown in FIG. 1 and FIG. 2, the standing-up assist tool (A) supports an armrest part 1 by a support mechanism 2 comprising a gas spring 22 in a state of being able both to tilt forward and backward and to move from a sitting corresponding position (T1) to a standing corresponding position (T2) located in a front upper side of the sitting corresponding position (T1) with forming an arc. Hereinafter, in this specification, the front side viewed by a user is called as "front" or "an opposite user side" and a backward viewed by the user is called as "back" or "a user side".

The armrest part 1 is an armrest 11 supported by an armrest support part 12.

The armrest 11 is so configured that a distance between a right part and a left part is narrowed toward the front and then the right part and the left part are connected in the front end side, and the whole is integrated to form a concave part (S1) that opens in the user side. The armrest 11 has a configuration wherein a core material, not shown in drawings, is surrounded by a surface material made of a material (for example, leather) that is difficult to be stained and easy to repel water. The surface material has a certain cushioning characteristic, and a peripheral, namely an outer circumference part and an inner circumference part, of the armrest 11 bulges upward so as to form a bank part, and an upper surface of the armrest 11 is provided with a processing of seamless of the surface material.

A main component of the armrest support part 12 is a pair of supporting rods 12*a* extending parallel in the front and back and the armrest 11 is mounted on the right and left supporting rods 12*a*, 12*a*. The supporting rods 12*a* ascend in the front and then mutually connected by a transverse rod 12*b* at a position higher than that of the armrest 11. A grip part 12*c* is formed by covering the transverse rod 12*b* with a non-slip agent made of urethane or the like.

On the other hand, the supporting mechanism 2 supports the armrest part 1 by the arm 21 and the gas spring 22 by means of the four-point link mechanism, and is arranged between the device body 3, of the walking support device (B) into which the standing-up assist tool (A) is incorporated, and the armrest part 1.

The device body 3 has a pipe frame structure. The pipe frame structure comprises a right side rim frame 31 having a right bottom frame member 31*a*, a right top frame member 31*b*, a right front frame member 31*c*, a right rear frame member 31*d* and a right oblique frame member 31*e*, and a left side rim frame 31 having a left bottom frame member 31*a*, a left top frame member 31*b*, a left front frame member 31*c*, a left rear frame member 31*d* and a left oblique frame member 31*e*, and the right and left bottom frame members 31*a*, 31*a* are connected by a connecting frame member 32*a*, and the right and left top frame members 31*b*, 31*b* are connected by a connecting frame member 32*b* so as to be a structure that can stand by itself. A concave part (S2) that opens in the user side is formed inside of the device body 3. A bottom end of the front frame member 31*c* is supported by a front caster 33, and a bottom end of the rear frame member 31*d* is supported by a rear caster 34. The front and rear casters 33, 34 are of a swing type and provided with a lock function to lock a rotational movement.

A bracket 35 is fixed to an internal corner of the top frame member 31*b* and the front frame member 31*c*, a bracket 12*d* is arranged to hang downward to the user side of the armrest support part 12 so as to be a support part of the user side, a proximal end of the arm 21 is rotatably mounted on the bracket 35 around a first fixed fulcrum (m1), and one of a distal ends of the arm 21 is rotatably mounted on the support part 12*d* of the user side around a first movable fulcrum (n1). The right and left arms 21, 21 are connected by a connecting member 21*a* at the distal end thereof.

In addition, a bracket 36 is fixed to an external corner of the bottom frame member 31*a* and the rear frame member 31*d*, a support part 12*e* is arranged to hang downward to the opposite user side of the armrest support part 12 so as to be a support part of the opposite user side, a proximal end of the gas spring 22 is rotatably mounted on the bracket 36 around a second fixed fulcrum (m2), and a distal end of the gas spring 22 is rotatably mounted on the support part 12*e* of the opposite user side around a second movable fulcrum (n2).

More specifically, as shown in FIG. 3, in a state that the gas spring 22 is locked, the armrest part 1 is supported in a state of being able to change a posture between an ordinary posture and a forward-tilt posture that tilts forward from the ordinary posture while accompanying a rotational movement of the arm 21 around the first fixed fulcrum (m1) and a rotational movement of the gas spring 22 around the second fixed fulcrum (m2) in accordance with a travelling portion of the first and second movable fulcrums (n1), (n2) due to the rotational movement. As shown in FIG. 2, in a state that the gas spring 22 is unlocked, the armrest part 1 is supported in a movable state with forming an arc from a sitting corresponding position (T1) to a standing corresponding position (T2) that is located at a forward upward position of the sitting corresponding position (T1) mainly by the extending movement of the gas spring 22 and the rotational movement of the arm 21.

Furthermore, as shown in FIG. 4 and FIG. 5, a gas spring switch part 4 that does not obstruct the locked state of the gas spring 22 at a time when the armrest part 1 is in the ordinary posture and that releases the locked state of the gas spring 22 at a time when the armrest part 1 is in the forward-tilt posture is arranged between an upper end part of the gas spring 22 and the armrest part 1. The gas spring switch part 4 is omitted to show in the drawings except for FIG. 4~FIG. 6.

The gas spring switch part 4 has a roller 41 at a position that the roller 41 indirectly acts on a switch 22*a* as being an input end of the gas spring 22 at a time when the armrest part 1 is in the forward-tilt posture. More concretely, a bracket 23 of a channel shape that opens upward is fixed to a top end of the gas spring 22, an upright wall 23*a* of the bracket 23 is connected to the support part 12*e* located at the opposite user side of the armrest part 1 through the second movable fulcrum (n2) and an arm 42 that supports the roller 41 is mounted on a third support part 12*f* arranged at a position displaced furthermore to the opposite user side from the support part 12*e* located at the opposite user side through a support shaft (n3). In addition, near the roller 41, a pendulum member 43 of a channel shape that opens upward is mounted between the upright walls 23*a*, 23*a* of the bracket 23 through a support shaft (n4). The pendulum member 43 is located at a position that faces to the switch 22*a* that projects from the top end of the gas spring 22, and at a time when the armrest part 1 tilts forward, the roller 41 descends along a front edge of the upright wall 23*a* and the support shaft (n3) enters a cutout 43*a* arranged on the pendulum member 43 and furthermore the roller 41 pushes down the pendulum member 43 to switch on the switch 22*a* of the gas spring 22 so as to release the locked state.

In addition, the arm 42 that supports the roller 41 extends to the opposite user side with forming a reversed "V" shape as shown in FIG. 4 and FIG. 6, and a handle 44 is mounted on a position where the arm 42 extends. When the handle 44 is operated to rotate upward around the support shaft (n3), the switch 22*a* of the gas spring 22 is pushed so as to release the locked state by separating a forward and backward tilting motion of the armrest part 1.

Since a reactive force is applied to the switch 22*a* of the gas spring 22, in case that no load is applied from the upward or no operating force is applied to the handle 44, the switch 22*a* is released and projects again so that the gas spring 22 is in a locked state. It is a matter of course that the gas spring 22 may be returned to a locked state by the use of an urging force of a spring or the like.

As shown in FIG. 1 and FIG. 2, the arm 21 extends to a position that exceeds the first fixed fulcrum (m1) and a rotational movement operation input part 5, made of a pipe material that can be stepped into by foot, is mounted between the left arm 21 and the right arm 21.

Next, handling of the walking support device (B) into which the standing-up assist tool (A) is incorporated will be explained.

Figure 7:
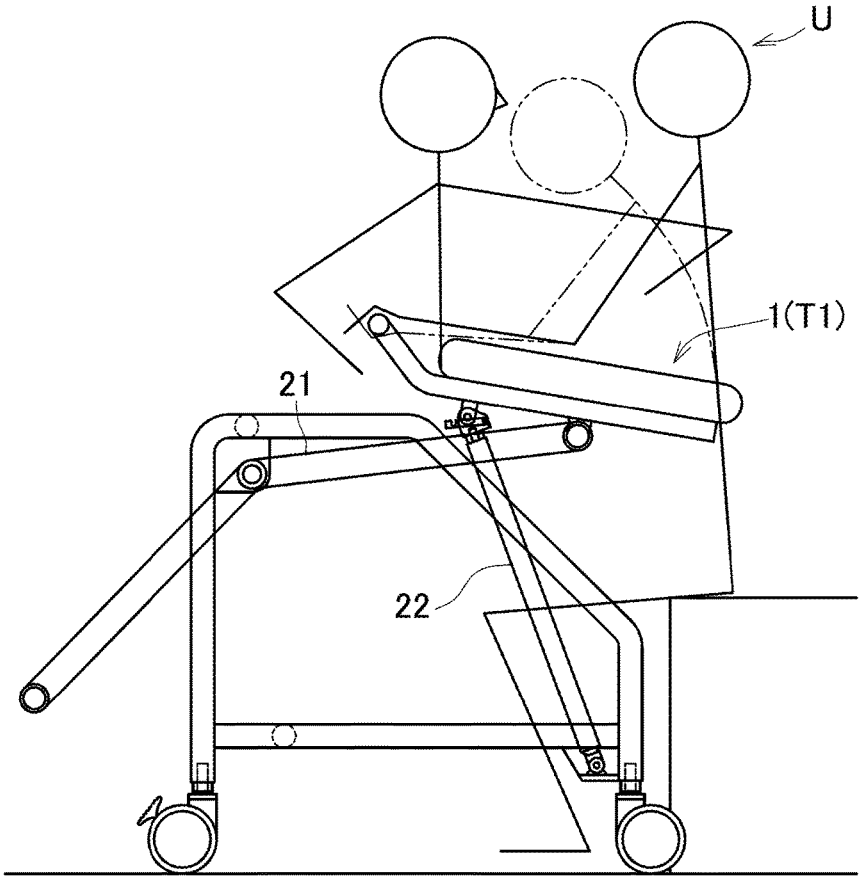
FIG. 7 is a view showing a use state of this embodiment.
Figure 8:
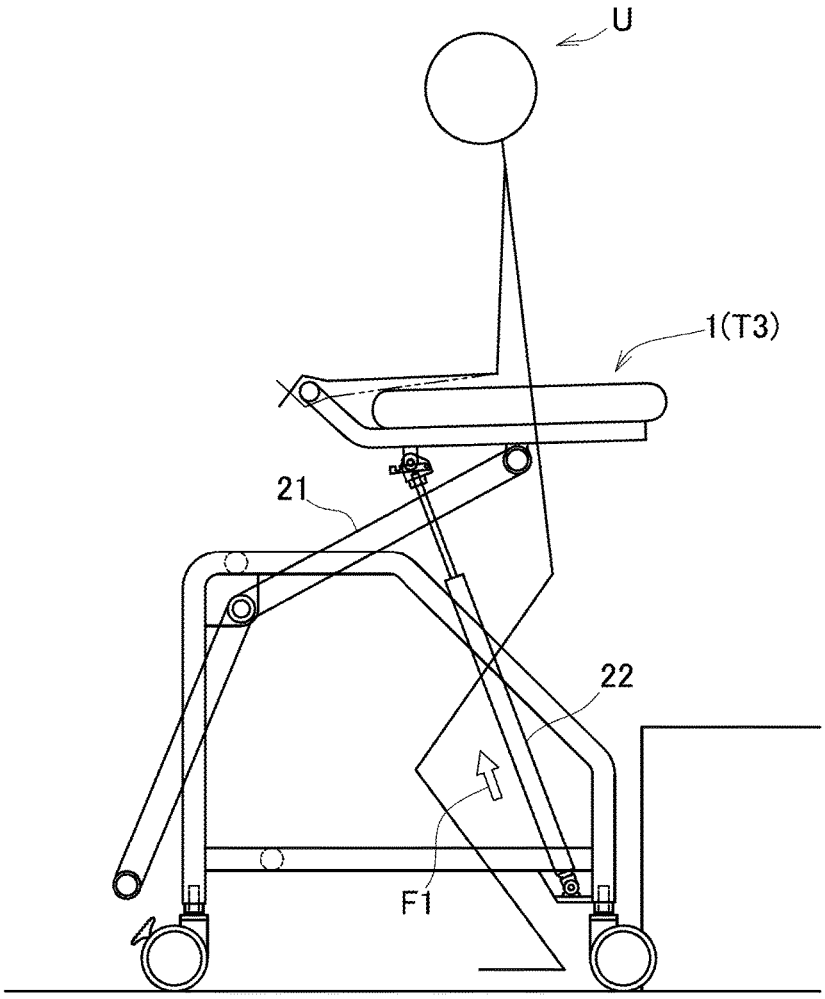
FIG. 8 is a view showing a use state of this embodiment.
Figure 9:
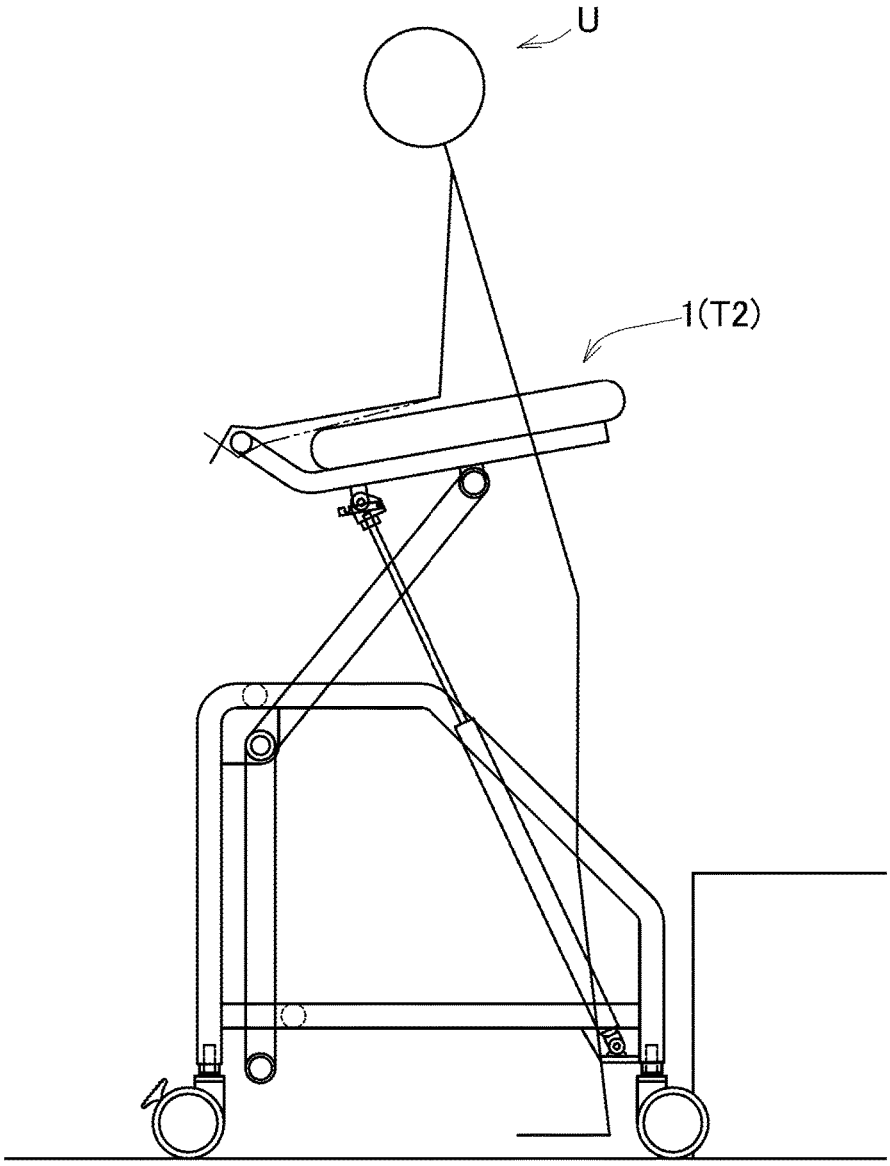
FIG. 9 is a view showing a use state of this embodiment.

When a user (U) in a sitting posture as shown in FIG. 7 puts his/her weight on the armrest part 1 located at the sitting corresponding position (T1) as shown by an imaginary line, the armrest part 1 tilts forward because a load shown by an arrow (P1) is applied to a front end side of the armrest part 1 as shown in FIG. 5. When the armrest part 1 tilts forward until it reaches a certain angle, the switch 22*a* of the gas spring 22 is pushed and the locked state is released. As a result of this, as shown in FIG. 8, a lifting force (F1) is generated to the armrest part 1 from the gas spring 22 so that a force required for the user (U) to stand up is reduced. Then it is possible for the user (U) to stand up to the standing corresponding position (T2) shown in FIG. 9 through a middle position (T3) shown in FIG. 8 by making use of the motion of the armrest part 1. When the forward-tilt posture of the armrest part 1 is released at the standing corresponding position (T2) or the middle position (T3), the four-point link mechanism shown in FIG. 3 guides the armrest part 1 to the rearward-tilt posture so that the gas spring 22 is locked and the armrest part 1 is supported at the position in the ordinary posture. In this state, even though a vertical load is applied to the armrest part 1 at the middle position or a rearward position (the user side), the locked state of the gas spring 22 is not released so that it is possible for the user (U) to stably put his/her weight on the armrest part 1. In case of a sitting motion, a reverse operation like FIG. 9 to FIG. 8 to FIG. 7 will assist the user (U) to take the sitting posture by reducing the weight of the user (U) by means of the gas spring 22. It is also possible for the user (U) to grip the grip part 12*c* as shown by a solid line in FIG. 7~FIG. 9, however, it is also effective that the user (U) grips the grip part 12*c* underhand as shown by an imaginary line in FIG. 7~FIG. 9. In accordance with this arrangement, the user's (U) upper arms are attached to his/her body so that it becomes easy for the user (U) to exert his/her strength and it is possible to securely pull the grip part 12*c* with his/her elbow used as a fulcrum.

Figure 10:
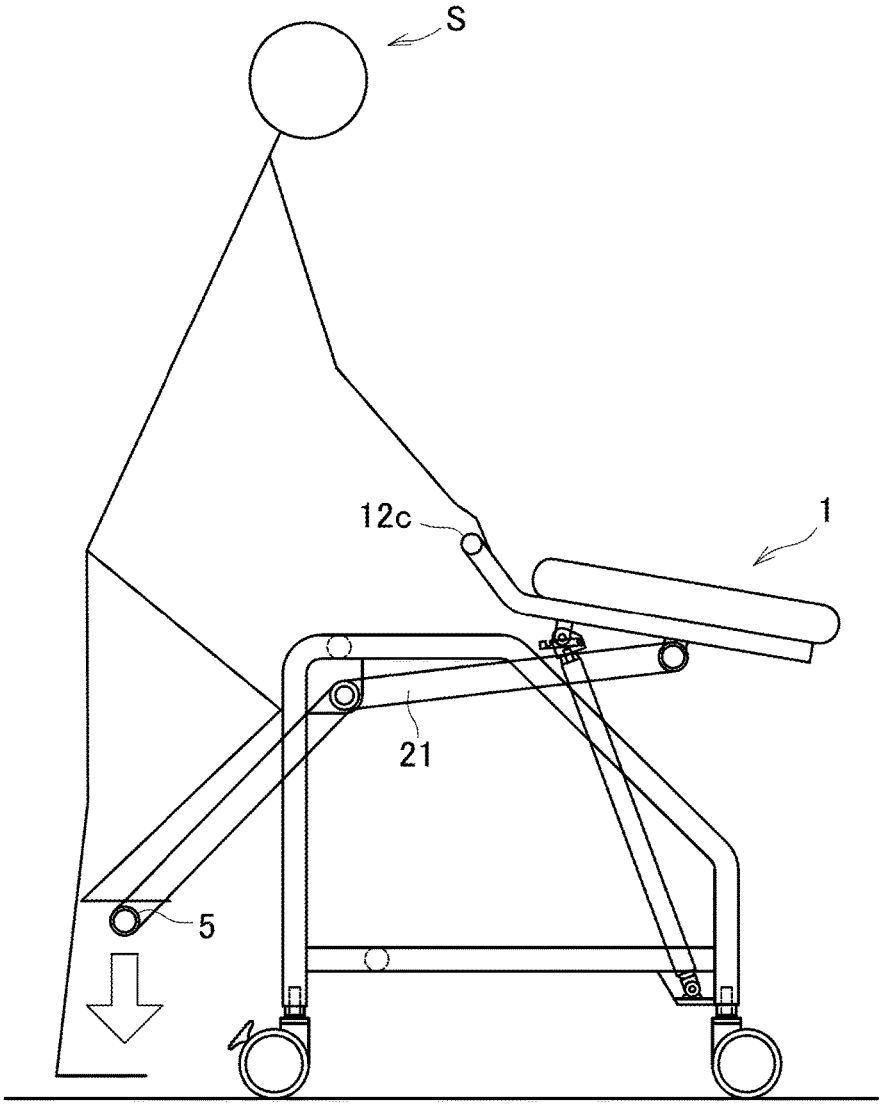
FIG. 10 is a view showing a use state of this embodiment.

As mentioned above, since the motion of the forward-tilt and rearward-tilt is utilized as the ON/OFF switch of the gas spring 22, there is no need of an additional switch operation. In addition, since it is possible for the user (U) to conduct a continuous standing or sitting motion including a switching motion of ON/OFF of the gas spring 22 with a natural movement such that the user (U) hangs over the armrest part 1 in a state that the user (U) puts his/her weight on the armrest part 1, there is no need for the helper (S) to assist the sitting/standing motion of the user (U) while supporting all of the weight of the user (U). As a result of this, it is possible to largely reduce a burden for the helper (S), and to solve a problem that both hands of the helper (S) are occupied. It is a matter of course that it is also possible for the helper (S) to effectively assist the forward-tilt movement of the armrest part 1 while applying a load by putting the hand of the helper (S) on the armrest part 1 or by gripping the grip part 12*c* from a position facing the user (U) as shown in FIG. 10. Alternatively, in case that the helper (S) cannot go around to the rear of the user (U) because there is a bed or the like, this arrangement can be an appropriate assist for the helper (S) in case that the helper (S) raises the waist or the back of the user (U) in his/her arm from the side of the user (U) as shown in FIG. 7. In addition, since it is possible to lock the armrest part 1 at an arbitrary height, the armrest part 1 can be used at an appropriate height in case that the helper (S) takes care of the user (U) in a half-sitting posture as shown in FIG. 8 so that a workload that used to be born by two or more helpers can be remarkably reduced. It is a matter of course that the standing-up assist tool (A) can be an effective tool for the user (U) to stand up or sit by him/herself.

Especially, the support mechanism 2 comprises the arm 21 that makes the rotational movement around the first fixed fulcrum (m1) and the gas spring 22 that makes the rotational movement around the second fixed fulcrum (m2), and supports the support part 12*d* that is set at the user side of the armrest part 1 by the rotational end part of the arm 21 and the support part 12*e* that is set at the opposite user side of the armrest part 1 by the rotational end part of the gas spring 22. The support part 12*d* at the user side is mounted rotatably around the first movable fulcrum (n1) set on the rotational end part of the arm 21, and the support part 12*e* at the opposite user side is mounted rotatably around the second movable fulcrum (n2) set on the rotational end part of the gas spring 22. In a state that the gas spring 22 is locked, since the armrest part 1 can take the ordinary posture and the forward-tilt posture that tilts forward from the ordinary posture while accompanying the rotational movement of the arm 21 around the first fixed fulcrum (m1) and the rotational movement of the gas spring 22 around the second fixed fulcrum (m2), it is possible to take the armrest part 1 in the forward and rearward-tilt posture in a locked state by preferably making use of four-point link mechanism. In addition, it is also possible to realize a movement to assist the standing motion of the user (U) along a natural track by the use of a transfer motion, drawing an arc, of the armrest part 1 by making use of expansion and contraction of the gas spring 22 and the rotational movement of the arm 21 in the unlocked state with a simple arrangement.

In addition, since the arm 21 is provided with the rotational movement operation input part 5 that can be stepped on by foot at a position exceeding the first fixed fulcrum (m1), it is possible to encourage the rotational force of the arm 21 and to effectively assist the force for the user (U) to stand-up if the helper (S) puts his/her foot to apply his/her weight on the rotational movement operation input part 5 from a position facing the user (U) as shown in FIG. 10.

Furthermore, since the gas spring switch part 4 has the roller 41 as being the pressing part at a position that indirectly acts on the switch 22*a* as being the input end of the gas spring 22 at a time when the armrest part 1 is in the forward-tilt posture, and the roller 41 is operable by being separated from the movement of the armrest part 1 by the handle 44 that is attached to the armrest part 1 and that is arranged at a position that extends along the opposite user side, it is also possible for the helper (S) who is at the position facing to the user (U) to conduct a release operation of the gas spring 22.

In addition, since the grip part 12*c* is located in front of the armrest part 1, if the user (U) grips the grip part 12*c*, it is possible for the user (U) to stably put his/her weight on the armrest part 1 and furthermore to walk stably, and to appropriately change how to put his/her weight as well.

Since the walking support device (B) into which the standing-up assist tool (A) is incorporated is configured by mounting the arm 21 and the gas spring 22 on the device body 3 that is supported by the casters 33, 34 and that has the concave part (S2) into which the user (U) can enter through the first fixed fulcrum (m1) and the second fixed fulcrum (m2), it is possible to move freely, to make it easy to sit/stand at an arbitrary position and to stand by holding the standing-up assist tool (A) with a simple configuration at low cost.

Each part of the concrete configuration is not limited to the above-mentioned embodiment.

FIG. 11~FIG. 15 shows a walking support device whose detailed design is changed with keeping the fundamental functions of the above-mentioned embodiment. The parts having the same function as those in the above-mentioned embodiment are denoted by the same reference numerals as those in the above-mentioned embodiment, and descriptions about the parts other than the main components will be omitted.

This standing-up assist tool (A) also supports the armrest support part 1 by the support mechanism 2 comprising the gas spring 22. The support mechanism 2 supports the armrest part 1 in a state of being able to change the posture between the ordinary posture shown by a solid line in FIG. 13 and the forward-tilt posture shown by an imaginary line in FIG. 13 in a state that the gas spring 22 is locked, and supports the armrest part 1 in a movable state with forming an arc from the sitting corresponding position (T1) shown in FIG. 13 to the standing corresponding position (T2) shown in FIG. 14 located at a front upper part of the sitting corresponding position (T1) in a state that the gas spring 22 is unlocked. The gas spring switch part 4 (refer to FIG. 5) that does not obstruct the locked state of the gas spring 22 at a time when the armrest part 1 is in the ordinary posture and that releases the locked state of the gas spring 22 at a time when the armrest part 1 is in the forward-tilt posture is arranged between the gas spring 22 and the armrest part 1.

The support mechanism 2 comprises the arm 21 that makes a rotational movement around the first fixed fulcrum (m1) and the gas spring 22 that makes a rotational movement around the second fixed fulcrum (m2), and supports the support part 12*d* located at the user side of the armrest part 1 through a rotational end part of the arm 21 and the support part 12*e* located at the opposite user side of the armrest part 1 through a rotational end part of the gas spring 22. The support part 12*d* located at the user side is rotatably mounted on the first movable fulcrum (n1) set at the rotational end part of the arm 21, and the support part 12*e* located at the opposite user side is rotatably mounted on the second movable fulcrum (n2) set at the rotational end part of the gas spring 22. Similar to the drawing shown in FIG. 3, in a state that the gas spring 22 is locked, the armrest part 1 is so configured that can take the ordinary posture shown by a solid line in FIG. 13 and the forward-tilt posture shown by an imaginary line in FIG. 13 while accompanying the rotational movement of the arm 21 around the first fixed fulcrum (m1) and the rotational movement of the gas spring 22 around the second fixed fulcrum (m2).

In addition, the arm 21 is provided with the rotational movement operation input part 5 that allows a foot to step on at a position exceeding the first fixed fulcrum (m1). In this modified embodiment, a rib 21*r* is arranged at a bent part of the arm 21 and an opening angle θ is made small. With this arrangement, a protruding amount (D) from the device body 3 (a front frame member 31*c*) to the rotational movement operation input part 5 in case that the armrest part 1 is at the sitting corresponding position (T1) shown in FIG. 13 can be reduced compared with the arrangement shown in FIG. 2.

Figure 13:
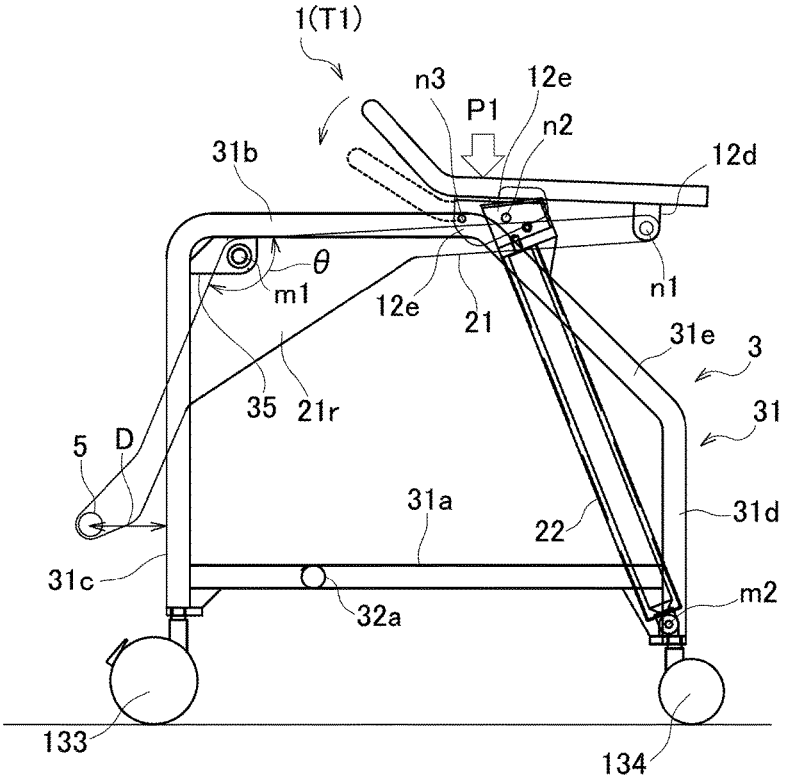
FIG. 13 is a side view of the modified example corresponding to FIG. 2.
Figure 15:
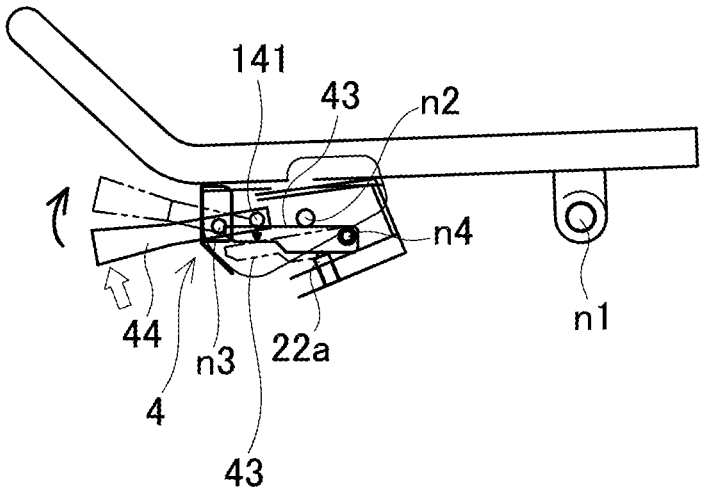
FIG. 15 is an enlarged partial side view of the modified example corresponding to FIG. 6.

The gas spring switch part 4 has a pushing pin 141 as being the pressing part at a position where the pushing pin 141 indirectly acts on the input end of the gas spring 22 when the armrest part 1 is in the forward-tilt posture shown by the imaginary line in FIG. 13, and the pushing pin 141 can be operated separately from the movement of the armrest part 1 by the handle 44 arranged at a portion that is attached to the armrest part 1 and that extends along the opposite user side. In other words, as shown in FIG. 13, a load shown by an arrow (P1) is applied to the front end side of the armrest part 1 so that the armrest part 1 tilts forward and when the armrest part 1 tilts forward until it reaches a certain angle, the second movable fulcrum (n2) pushes down the pendulum member 43. As a result of this, the switch 22*a* of the gas spring 22 is pushed so that the locked state is released. Alternatively, when the handle 44 is operated to rotate upward around the support shaft (n3) as shown in FIG. 15, the pin 141 pushes down the pendulum member 43. As a result of this, it is also possible to release the locked state by pushing the switch 22*a* of the gas spring 22.

Figure 12:
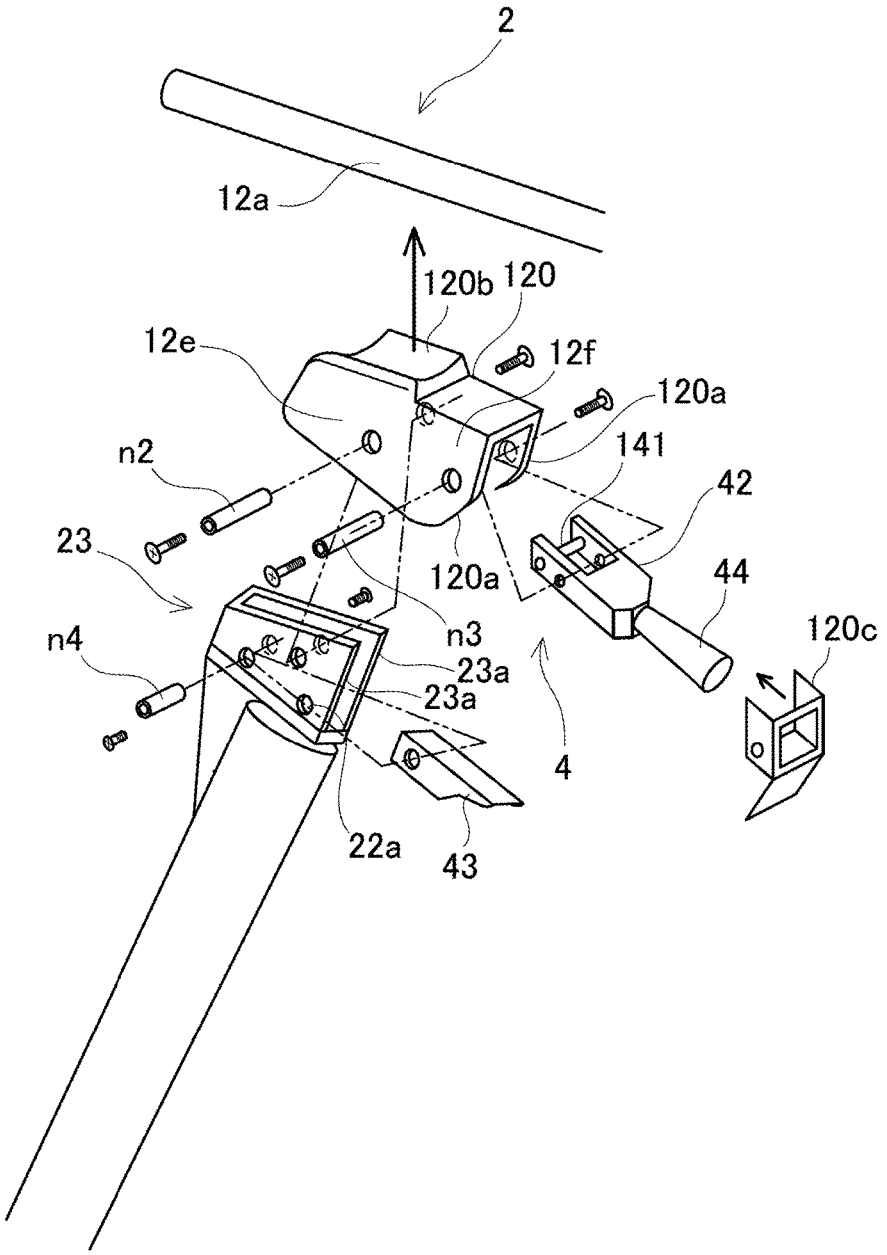
FIG. 12 is an exploded perspective view of the modified example corresponding to FIG. 4.
Figure 14:
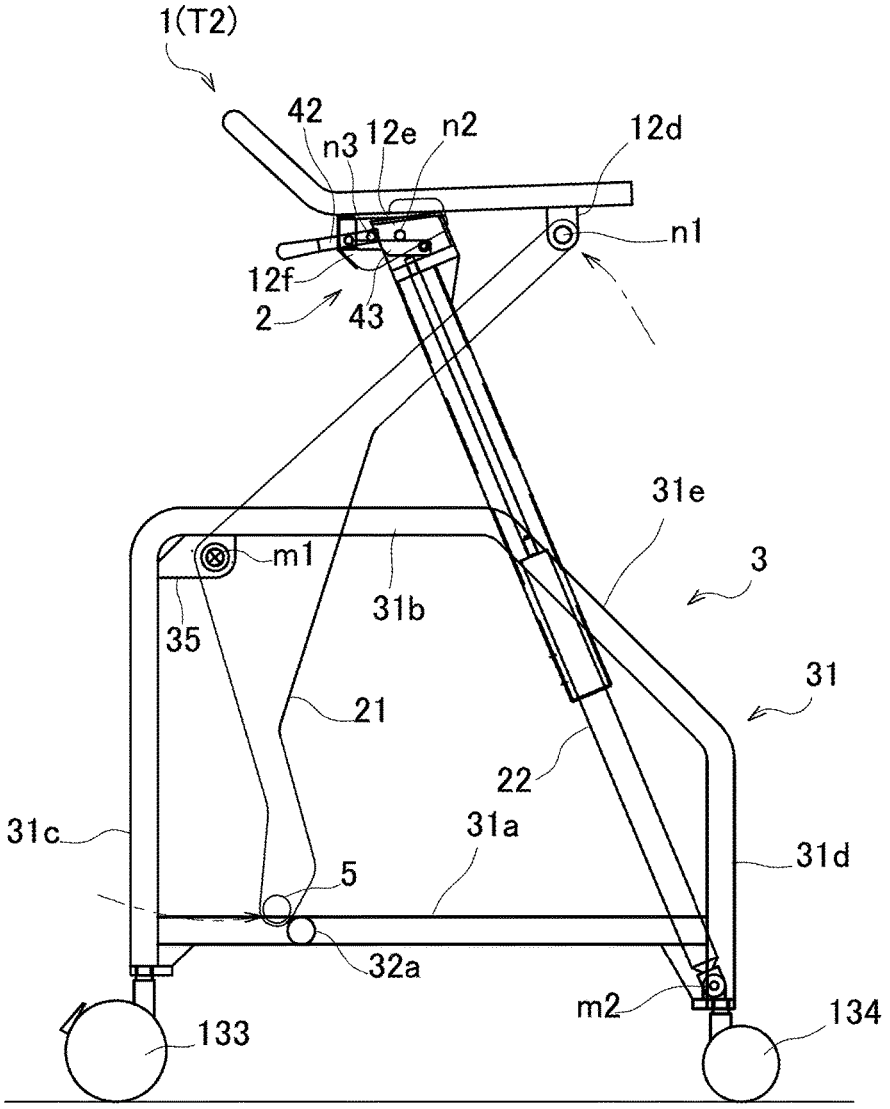
FIG. 14 is a side view of the modified example corresponding to FIG. 2.

As shown in FIG. 12 and FIG. 14, the arm 42 that supports the pin 141 is mounted on the third support part 12*f* arranged at a position displaced furthermore to the opposite user side from the support part 12*e* located at the opposite user side of the armrest part 1 through the support shaft (n3), and the pin 141 can be operated to move rotatably around the support shaft (n3) by the handle 44 arranged across the support shaft (n3) from the pin 141. Together with the support part 12*e*, the support part 12*f* is set on a side wall 120*a* of a bracket 120 of a channel shape that opens downward, and the side wall 120*a* is assembled at a position that overlaps an outside of the side wall 23*a* of the bracket 23 that has a channel shape opening upward and that is mounted on the upper end of the gas spring 22, and an upper wall 120*b* is rigidly joined to the support rod 12*a* constituting the armrest part 1. The support shaft (n3) jointly fastens a cover 120C that closes an opening end of the bracket 120 in case of mounting the arm 42 on the support part 12*f*, and the handle 44 penetrates a window arranged for the cover 120C and is pulled out from the window so as not to interfere the rotational operation of the handle 44. Since a spring reaction force in the projecting direction is applied to the switch 22*a* of the gas spring 22, in case that no load is applied to the handle 44 from the upside or no operational force is applied to the handle 44, the switch 22*a* is released so that the switch 22*a* projects and the gas spring 22 is locked again.

Figure 11:
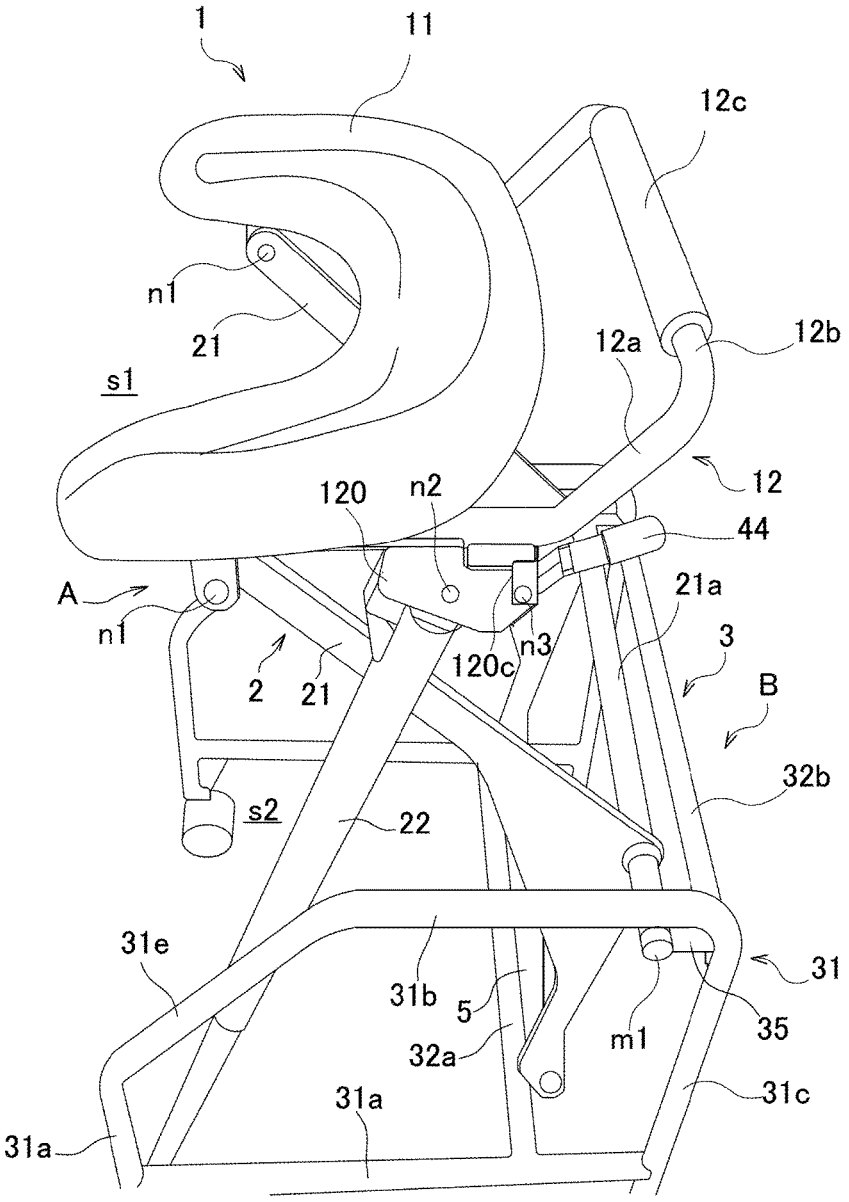
FIG. 11 is a perspective view showing a modified example of this invention corresponding to FIG. 1.

As shown in FIG. 11, that the grip part 12*c* is located in front of the armrest part 1 is the same as that in the above-mentioned embodiment.

In addition, also in this modified embodiment, the walking support device (B) into which the standing-up assist tool (A) is incorporated is configured by mounting the arm 21 and the gas spring 22 on the device body 2 that is supported by the front caster 133 and the rear caster 134 and that has the concave part (S2) into which the user (U) can enter through the first fixed fulcrum (m1) and the second fixed fulcrum (m2). However, in accordance with this configuration, since a certain length of the gas spring 22 is required and the second fixed fulcrum (m2) is located near a floor, a diameter of the rear caster 134 arranged under the second fixed fulcrum (m2) is made smaller than that of the front caster 133. In this modified embodiment, the lock mechanism is provided for the front caster 133 alone. The above-mentioned configuration also produces fundamentally the same operation and effect as that of the above-mentioned embodiment. Other may be variously modified.

For example, "forward-tilt" and "rearward-tilt" of the armrest part at a time when the gas spring is in the locked state do not necessarily set a horizontal direction as a reference, and may be set at an arbitrary angle as far as the armrest part is relatively forward-tilt or rearward-tilt.

In addition, in the above-mentioned embodiment, the gas spring switch part is provided with the roller as being the pushing part at a position that indirectly acts on the input end of the gas spring at a time when the armrest part is in the forward-tilt posture, however, the roller may be arranged at a position that directly acts on the input end of the gas spring and structurally other configuration may be appropriately adopted.

Furthermore, a concrete configuration of the support mechanism is not limited to the above-mentioned configuration as far as the support mechanism supports the armrest part in the state of being able to change the posture between the ordinary posture and the forward-tilt posture in a state that the gas spring is locked, and supports the armrest part so as to make the armrest part move with forming an arc from the sitting corresponding position to the standing corresponding position that is located at the forward upward position in the state that the gas spring is unlocked In addition, in the above-mentioned embodiment, the walking support device into which the standing-up assist tool is incorporated is used, in other words, the walking-support device comprises a function of a lifter by which the user is lifted, however, the walking support device may be used only as the standing-up assist tool by being placed on a bedside, so called a dedicated lifter. With this arrangement, it is possible to obtain the operation and the effect similar to that of the above-mentioned embodiment.

Other arrangement may be variously modified without departing from the spirit of this invention.

EXPLANATION OF CODES

1 . . . armrest part
2 . . . support mechanism
3 . . . device body
4 . . . gas spring switch part
5 . . . rotational movement operation input part
12*d* . . . support part at user side
12*e* . . . support part at opposite user side
21 . . . arm
22 . . . gas spring
33, 34 . . . caster
41 . . . pushing part (roller)
44 . . . handle
A . . . standing-up assist tool
B . . . walking support device
m1 . . . first fixed fulcrum
m2 . . . second fixed fulcrum
n1 . . . first movable fulcrum
n2 . . . second movable fulcrum
T1 . . . sitting corresponding position
T2 . . . standing corresponding position

The invention claimed is:

1. A standing-up assist tool comprising:

an armrest part, and a supporting mechanism that supports the armrest part; the supporting mechanism comprising a gas spring; and a gas spring switch part that does not obstruct a locked state of the gas spring at a time when the armrest part is in an ordinary posture and that releases the locked state of the gas spring at a time when the armrest part is in a forward-tilt posture is provided between the gas spring and the armrest part, wherein the support mechanism comprises an arm that makes a rotational movement around a first fixed fulcrum and the gas spring that makes a rotational movement around a second fixed fulcrum, and a rear support part of the armrest part is supported by a rotational movement end part of the arm and a front support part of the armrest part is supported by a rotational movement end part of the gas spring, the rear support part of the armrest part is supported by a first movable fulcrum which rotates accompanying the rotational movement of the arm around the first fixed fulcrum, and the front support part of the armrest part is supported by a second movable fulcrum which rotates accompanying the rotational movement of the gas spring around the second fixed fulcrum, wherein the rear support part is mounted in a rotatable manner around the first movable fulcrum set on the rotational movement end part of the arm and the front support part is mounted in a rotatable manner around the second movable fulcrum set on the rotational movement end part of the gas spring, the armrest part is capable of taking both the ordinary posture and the forward-tilt posture that tilts forward from the ordinary posture while accompanying the rotational movement of the arm around the first fixed fulcrum and the rotational movement of the gas spring around the second fixed fulcrum in the state that the length of the gas spring is locked, and wherein the arm is provided with a rotational movement operation input part that is capable of being stepped on by a foot at a position at the opposite side of the rotational movement end part of the arm across the first fixed fulcrum, and wherein the support mechanism supports the armrest part in a state of being able to change a posture between the ordinary posture and the forward-tilt posture in a state that a length of the gas spring is locked, and supports the armrest part by stretching movement and the rotational movement of the gas spring and the rotational movement of the arm so as to make the armrest part move from a sitting corresponding position to a standing corresponding position that is located at a forward upward position of the sitting corresponding position in a state that the length of the gas spring is unlocked.

2. The standing-up assist tool descried in claim 1, wherein the gas spring switch part has a pressing part at a position where the pressing part directly or indirectly acts on an input end of the gas spring when the armrest part is in the forward-tilt posture, and the pressing part can be operated separately from a movement of the armrest part by a handle that is attached to the armrest part and extends to the opposite user side.

3. A walking support device comprising: the stand-up assist tool of claim 2, wherein the first fixed fulcrum and the second fixed fulcrum are set on a device body that is supported by casters and that has a concave part which a user can get into, and the arm and the gas spring are mounted on the device body.

4. The standing-up assist tool described in claim 1, wherein a grip part is located in front of the armrest part.

5. A walking support device comprising: the stand-up assist tool of claim 1, wherein the first fixed fulcrum and the second fixed fulcrum are set on a device body that is supported by casters and that has a concave part which a user can get into, and the arm and the gas spring are mounted on the device body.

* * * * *